US011270580B2

(12) United States Patent
Yamazaki et al.

(10) Patent No.: US 11,270,580 B2
(45) Date of Patent: Mar. 8, 2022

(54) TRAFFIC SIGNAL CONTROL APPARATUS, TRAFFIC SIGNAL CONTROL METHOD, AND COMPUTER PROGRAM

(71) Applicant: SUMITOMO ELECTRIC INDUSTRIES, LTD., Osaka (JP)

(72) Inventors: Nobuhiro Yamazaki, Osaka (JP); Hajime Sakakibara, Osaka (JP); Arata Doi, Osaka (JP); Hiroshi Matsumoto, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/957,619

(22) PCT Filed: Dec. 12, 2018

(86) PCT No.: PCT/JP2018/045682
§ 371 (c)(1),
(2) Date: Jun. 24, 2020

(87) PCT Pub. No.: WO2019/163262
PCT Pub. Date: Aug. 29, 2019

(65) Prior Publication Data

US 2021/0056840 A1 Feb. 25, 2021

(30) Foreign Application Priority Data

Feb. 23, 2018 (JP) ..... JP2018-030885

(51) Int. Cl.
*G08G 1/08* (2006.01)
*G08G 1/095* (2006.01)
*G08G 1/00* (2006.01)

(52) U.S. Cl.
CPC ..... *G08G 1/08* (2013.01); *G08G 1/095* (2013.01); *G08G 1/22* (2013.01)

(58) Field of Classification Search
CPC ..... G08G 1/08; G08G 1/095; G08G 1/22; G08G 1/087
See application file for complete search history.

(56) References Cited

U.S. PATENT DOCUMENTS 4,303,905 A * 12/1981 Drebinger ..... G08G 1/08 340/922
6,326,903 B1 * 12/2001 Gross ..... G08G 1/087 340/902

(Continued)

FOREIGN PATENT DOCUMENTS

JP 2008-051623 A 3/2008
JP 2011-020551 A 2/2011

(Continued)

*Primary Examiner* — Hoi C Lau
(74) *Attorney, Agent, or Firm* — Oliff PLC

(57) ABSTRACT

A traffic signal control apparatus capable of controlling signal light colors at a target intersection includes: an acquisition unit configured to acquire positional information of a tail-end vehicle among platoon vehicles traveling on an inflow road of the target intersection, and a vehicle speed of the platoon vehicles; and a control unit configured to, when the tail-end vehicle cannot pass a stop line of the target intersection by the time a remaining green interval elapses, execute preferential control that allows the platoon vehicles to preferentially pass through the target intersection by extending a clearance interval of the target intersection.

5 Claims, 7 Drawing Sheets

(56) References Cited

U.S. PATENT DOCUMENTS 6,339,383 B1* 1/2002 Kobayashi ..... G08G 1/08 340/907
7,860,639 B2* 12/2010 Yang ..... G08G 1/081 701/117
10,186,148 B2* 1/2019 Umehara ..... H04W 4/44
10,210,755 B1* 2/2019 Franco ..... G08G 1/096716
10,249,183 B2* 4/2019 Umehara ..... G08G 1/0133
10,546,493 B2* 1/2020 Franco ..... G08G 1/0145
10,713,941 B2* 7/2020 Franco ..... G08G 1/0112
10,719,084 B2* 7/2020 Yoon ..... G08G 1/22
10,755,563 B2* 8/2020 Takeda ..... H04W 4/44
10,814,872 B2* 10/2020 Sofra ..... G05D 1/0289
10,937,313 B2* 3/2021 Ma ..... G08G 1/08
11,011,064 B2* 5/2021 Zhou ..... G08G 1/162
11,022,981 B2* 6/2021 Borhan ..... G05D 1/0027
11,037,441 B2* 6/2021 Jiang ..... G08G 1/083
11,069,233 B1* 7/2021 Gao ..... G08G 1/0129
11,080,998 B2* 8/2021 Khalid ..... G08G 1/0145
11,113,960 B2* 9/2021 Felip Leon ..... G08G 1/0145
2002/0116118 A1* 8/2002 Stallard ..... G08G 1/083 701/117
2004/0145497 A1* 7/2004 Pearson ..... G08G 1/07 340/906
2004/0246144 A1* 12/2004 Siegel ..... G08G 1/0965 340/902
2006/0155427 A1* 7/2006 Yang ..... G08G 1/081 701/1
2007/0040700 A1* 2/2007 Bachelder ..... G08G 1/087 340/902
2009/0284395 A1 11/2009 Bushman
2010/0153002 A1* 6/2010 Lee ..... G08G 1/087 701/533
2011/0191011 A1* 8/2011 McBride ..... H04W 28/06 701/117
2012/0033123 A1* 2/2012 Inoue ..... G08G 1/08 348/333.13
2012/0188099 A1* 7/2012 Lee ..... G08G 1/087 340/906
2014/0372561 A1* 12/2014 Hisano ..... G08G 1/0112 709/217
2015/0199904 A1* 7/2015 Lee ..... G08G 1/096725 701/117
2015/0243165 A1* 8/2015 Elsheemy ..... B60R 25/00 340/906
2015/0269840 A1* 9/2015 Hirata ..... G08G 1/0129 701/118
2016/0055744 A1* 2/2016 Branson ..... G08G 1/0112 340/916
2016/0169688 A1* 6/2016 Kweon ..... G08G 1/162 701/522
2016/0171884 A1* 6/2016 Chen ..... G01C 7/04 701/117
2017/0270785 A1* 9/2017 Umehara ..... G08G 1/0112
2017/0352263 A1* 12/2017 Umehara ..... G08G 1/0133
2017/0372148 A1* 12/2017 Chen ..... G08G 1/0104
2020/0118428 A1* 4/2020 Takeda ..... G08G 1/0145
2020/0184827 A1* 6/2020 Park ..... H04L 67/125
2020/0286387 A1* 9/2020 Zhou ..... G08G 1/0175
2020/0294394 A1* 9/2020 Guo ..... G08G 1/22
2020/0327812 A1* 10/2020 Ran ..... G08G 1/096844
2020/0402406 A1* 12/2020 Sakakibara ..... G08G 1/096791
2021/0041893 A1* 2/2021 Matsumoto ..... G08G 1/22
2021/0042860 A1* 2/2021 Kawasaki ..... G06Q 50/30
2021/0056840 A1* 2/2021 Yamazaki ..... G08G 1/087
2021/0245755 A1* 8/2021 Bai ..... G05D 1/0088

FOREIGN PATENT DOCUMENTS

JP 2012-103843 A 5/2012
JP 2012-203785 A 10/2012
JP 2016-115123 A 6/2016

* cited by examiner

[FIRST PREFERENTIAL CONTROL FOR PLATOON]

TRAFFIC SIGNAL CONTROL APPARATUS, TRAFFIC SIGNAL CONTROL METHOD, AND COMPUTER PROGRAM

TECHNICAL FIELD

The present invention relates to a traffic signal control apparatus, a traffic signal control method, and a computer program which are capable of controlling signal light colors at a target intersection.

This application claims priority on Japanese Patent Application No. 2018-030885 filed on Feb. 23, 2018, the entire contents of which are incorporated herein by reference.

BACKGROUND ART

Patent Literature 1 discloses a traffic signal control apparatus including: an acquisition unit that acquires positional information of a leading vehicle in a vehicle group consisting of a plurality of public vehicles traveling in platoon, and the length of the vehicle group; and a control unit capable of executing, based on the acquired information, preferential control for vehicle group which is preferential control for the entirety of the public vehicles forming the vehicle group.

The traffic signal control apparatus disclosed in Patent Literature 1 is capable of performing the preferential control that allows the vehicle group consisting of the plurality of public vehicles to preferentially pass through the intersection without dividing the vehicle group.

CITATION LIST

Patent Literature

PATENT LITERATURE 1: Japanese Laid-Open Patent Publication No. 2016-115123

SUMMARY OF INVENTION (1) An apparatus according to an aspect of the present disclosure is a traffic signal control apparatus capable of controlling signal light colors at a target intersection, and the apparatus includes: an acquisition unit configured to acquire positional information of a tail-end vehicle among platoon vehicles traveling on an inflow road of the target intersection, and a vehicle speed of the platoon vehicles; and a control unit configured to, when the tail-end vehicle cannot pass a stop line of the target intersection by the time a remaining green interval elapses, execute preferential control that allows the platoon vehicles to preferentially pass through the target intersection by extending a clearance interval of the target intersection.

(4) An apparatus according to another aspect of the present disclosure is a traffic signal control apparatus capable of controlling signal light colors at a target intersection, and the apparatus includes: an acquisition unit configured to acquire a head position of platoon vehicles traveling on an inflow road of the target intersection, and a determination reference time point at which a time-difference phase at the target intersection is to be changed; and a control unit configured to, when the head position of the platoon vehicles at the determination reference time point is within a predetermined range before the target intersection, execute preferential control that allows the platoon vehicles to preferentially pass through the target intersection by adopting a time-difference phase that gives right-of-way in an inflow direction of the platoon vehicles.

(7) A method according to an aspect of the present disclosure is a traffic signal control method for controlling signal light colors at a target intersection, and the method includes: acquiring positional information of a tail-end vehicle among platoon vehicles traveling on an inflow road of the target intersection, and a vehicle speed of the platoon vehicles; and, when the tail-end vehicle cannot pass a stop line of the target intersection by the time a remaining green interval elapses, executing preferential control that allows the platoon vehicles to preferentially pass through the target intersection by extending a clearance interval of the target intersection.

(8) A computer program according to an aspect of the present disclosure is a computer program configured to cause a computer to function as a traffic signal control apparatus capable of controlling signal light colors at a target intersection. The computer program causes the computer to function as: an acquisition unit configured to acquire positional information of a tail-end vehicle among platoon vehicles traveling on an inflow road of the target intersection, and a vehicle speed of the platoon vehicles; and a control unit configured to, when the tail-end vehicle cannot pass a stop line of the target intersection by the time a remaining green interval elapses, execute preferential control that allows the platoon vehicles to preferentially pass through the target intersection by extending a clearance interval of the target intersection.

(9) A method according to another aspect of the present disclosure is a traffic signal control method for controlling signal light colors at a target intersection, and the method includes: acquiring a head position of platoon vehicles traveling on an inflow road of the target intersection, and a determination reference time point at which a time-difference phase at the target intersection is to be changed; and, when the head position of the platoon vehicles at the determination reference time point is within a predetermined range before the target intersection, executing preferential control that allows the platoon vehicles to preferentially pass through the target intersection by adopting a time-difference phase that gives right-of-way in an inflow direction of the platoon vehicles.

(10) A computer program according to another aspect of the present disclosure is a computer program configured to cause a computer to function as a traffic signal control apparatus capable of controlling signal light colors at a target intersection. The computer program causes the computer to function as: an acquisition unit configured to acquire a head position of platoon vehicles traveling on an inflow road of the target intersection, and a determination reference time point at which a time-difference phase at the target intersection is to be changed; and a control unit configured to, when the head position of the platoon vehicles at the determination reference time point is within a predetermined range before the target intersection, execute preferential control that allows the platoon vehicles to preferentially pass through the target intersection by adopting a time-difference phase that gives right-of-way in an inflow direction of the platoon vehicles.

DESCRIPTION OF EMBODIMENTS

Figure 1:
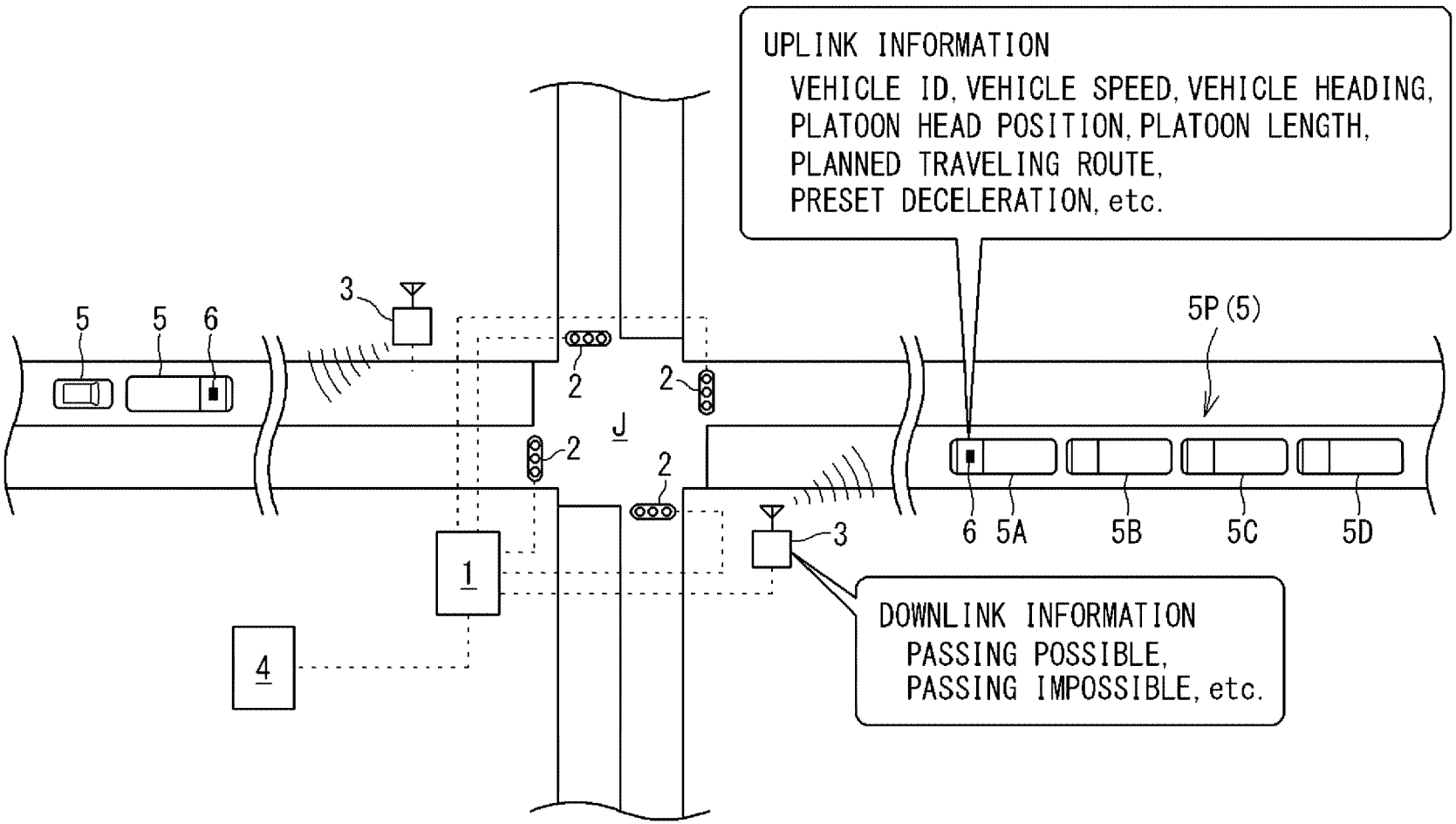
FIG. 1 is a road plan view showing an entire configuration of a traffic signal control system.

Problems to be Solved by the Present Disclosure

In the control of allowing a plurality of vehicles traveling in platoon (hereinafter, referred to as "platoon vehicles") to preferentially pass through an intersection, if the green interval is extended as in Patent Literature 1, vehicles present around the platoon vehicles are also allowed to pass through the intersection, which may impede smooth passing of the platoon vehicles through the intersection.

An object of the present disclosure is to provide a traffic signal control apparatus and the like which execute preferential control that allows platoon vehicles to smoothly pass through an intersection.

Effects of the Present Disclosure

According to the present disclosure, it is possible to execute preferential control that allows platoon vehicles to smoothly pass through an intersection.

Outline of Embodiment of the Present Disclosure

Hereinafter, the outline of an embodiment of the present invention will be listed and described.

(1) A first traffic signal control apparatus according to the present embodiment is capable of controlling signal light colors at a target intersection, and includes: an acquisition unit configured to acquire positional information of a tail-end vehicle among platoon vehicles traveling on an inflow road of the target intersection, and a vehicle speed of the platoon vehicles; and a control unit configured to, when the tail-end vehicle cannot pass a stop line of the target intersection by the time a remaining green interval elapses, execute preferential control that allows the platoon vehicles to preferentially pass through the target intersection by extending a clearance interval of the target intersection.

According to the first traffic signal control apparatus, if the tail-end vehicle cannot pass the stop line of the intersection by the time the remaining green interval elapses, the control unit executes the preferential control that allows the platoon vehicles to preferentially pass through the target intersection by extending the clearance interval of the target intersection. Therefore, the platoon vehicles can pass through the intersection more smoothly, compared to the preferential control with the green interval being extended.

(2) In the first traffic signal control apparatus, when the control unit extends the clearance interval of the target intersection, the control unit preferably notifies the platoon vehicles that the vehicles can pass through the target intersection.

Thus, the driver of the platoon vehicles (e.g., the driver of the leading vehicle) can perceive that the platoon vehicles can pass through the intersection, in advance before the intersection.

(3) In the first traffic signal control apparatus, when the control unit does not extend the clearance interval of the target intersection, the control unit preferably notifies the platoon vehicles to stop at the stop line of the target intersection.

Thus, the driver of the platoon vehicles (e.g., the driver of the leading vehicle) can perceive that the platoon vehicles cannot pass through the intersection, in advance before the intersection.

(4) A second traffic signal control apparatus according to the present embodiment is capable of controlling signal light colors at a target intersection, and includes: an acquisition unit configured to acquire a head position of platoon vehicles traveling on an inflow road of the target intersection, and a determination reference time point at which a time-difference phase at the target intersection is to be changed; and a control unit configured to, when the head position of the platoon vehicles at the determination reference time point is within a predetermined range before the target intersection, execute preferential control that allows the platoon vehicles to preferentially pass through the target intersection by adopting a time-difference phase that gives right-of-way in an inflow direction of the platoon vehicles.

According to the second traffic signal control apparatus, if the head position of the platoon vehicles at the determination reference time point is within the predetermined range before the target intersection, the control unit executes the preferential control that allows the platoon vehicles to preferentially pass through the target intersection by adopting the time-difference phase that gives the right-of-way in the inflow direction of the platoon vehicles. Therefore, the platoon vehicles can pass through the intersection more smoothly, compared to the preferential control with the green interval being extended.

(5) In the second traffic signal control apparatus, when the control unit adopts the time-difference phase that gives the right-of-way in the inflow direction of the platoon vehicles, the control unit preferably notifies the platoon vehicles that the vehicles can pass through the target intersection.

Thus, the driver of the platoon vehicles (e.g., the driver of the leading vehicle) can perceive that the platoon vehicles can pass through the intersection, in advance before the intersection.

(6) In the second traffic signal control apparatus, when the control unit adopts the time-difference phase that gives the right-of-way in the inflow direction of the platoon vehicles, the control unit preferably notifies a vehicle traveling in an opposite direction with respect to the platoon vehicles to stop at the stop line of the intersection.

Thus, the driver of the vehicle traveling in the opposite direction can perceive that his/her vehicle cannot pass through the intersection, in advance before the intersection.

(7) A first traffic signal control method according to the present embodiment is a control method executed by any of the traffic signal control apparatuses according to the above (1) to (3).

Therefore, the first traffic signal control method exhibits the same effects as those of the traffic signal control apparatuses according to the above (1) to (3).

(8) A first computer program according to the present embodiment is a program that causes a computer to function as any of the traffic signal control apparatuses according to the above (1) to (3).

Therefore, the first computer program exhibits the same effects as those of the traffic signal control apparatuses according to the above (1) to (3).

(9) A second traffic signal control method according to the present embodiment is a control method executed by any of the traffic signal control apparatuses according to the above (4) to (6).

Therefore, the second traffic signal control method exhibits the same effects as those of the traffic signal control apparatuses according to the above (4) to (6).

(10) A second computer program according to the present embodiment is a program that causes a computer to function as any of the traffic signal control apparatuses according to the above (4) to (6).

Therefore, the second computer program exhibits the same effects as those of the traffic signal control apparatuses according to the above (4) to (6).

Details of Embodiment of the Present Disclosure

Hereinafter, an embodiment of the present disclosure will be described in detail with reference to the drawings. At least some parts of the embodiment described below may be combined as desired.

In the present embodiment, light colors of signal light units comply with Japanese laws. Therefore, the light colors of the signal light units include green (in actuality, blue green), yellow, and red.

Green means that a vehicle can go straight ahead, turn left, and turn right at an intersection. Yellow means that a vehicle should not advance over a stop position (excluding a case where the vehicle cannot safely stop at the stop position). Red means that a vehicle should not advance over a stop position.

Therefore, green is a light color indicating that a vehicle traveling on an inflow road of an intersection has right-of-way at the intersection. Red is a light color indicating that the vehicle traveling on the inflow road of the intersection does not have right-of-way at the intersection. Yellow is a light color indicating that the vehicle does not have right-of-way in principle, but has right-of-way only when the vehicle cannot safely stop at the stop position.

In some countries, the light color indicating right-of-way (blue in Japanese language) is expressed as green. Meanwhile, in some countries, the light color indicating no right-of-way in principle (yellow in Japan) is expressed as orange or amber.

(Overall Configuration of System)

FIG. 1 is a road plan view showing the overall configuration of a traffic signal control system according to the present embodiment.

As shown in FIG. 1, the traffic signal control system of the present embodiment includes a traffic signal controller 1, signal light units 2, roadside communication apparatuses 3, a central apparatus 4, on-vehicle devices 6 mounted on vehicles 5, etc.

The vehicles 5 include platoon vehicles 5P consisting of a plurality of (four in the example of FIG. 1) vehicles 5A to 5D traveling in platoon with a short inter-vehicle distance. The vehicles 5A to 5D are large vehicles such as trucks, for example.

The vehicles 5A to 5D are not limited to large vehicles such as trucks and buses, and may be passenger cars such as taxies. The platoon vehicles 5P may be a combination of different types of vehicles 5A to 5D.

The following vehicles 5B and 5C can follow the preceding vehicles with a strict inter-vehicle distance according to CACC (Cooperative Adaptive Cruise Control).

In the present embodiment, it is assumed that the leading vehicle 5A of the platoon vehicles 5P is a manned vehicle while the following vehicles 5B to 5D are unmanned vehicles. However, the following vehicles 5B to 5D may be manned vehicles.

The traffic signal controller 1 is connected to a plurality of signal light units 2 installed at an intersection J via power lines. The traffic signal controller 1 is connected to the central apparatus 4 installed in a traffic control center or the like via a dedicated communication line.

The central apparatus 4 constructs a local area network with traffic signal controllers 1 installed at a plurality of intersections J within an area that the central apparatus 4 covers. Therefore, the central apparatus 4 is communicable with a plurality of traffic signal controllers 1, and each traffic signal controller 1 is communicable with the controllers 1 at other intersections J.

The central apparatus 4 receives, in each predetermined cycle (e.g., 1 min), sensor information measured by roadside sensors such as vehicle detectors and image sensors (not shown), and calculates, in each predetermined cycle (e.g., 2.5 min), a traffic index such as link travel time, based on the received sensor information.

The central apparatus 4 can perform traffic actuated control in which signal control parameters (split, cycle length, offset, and the like) at each intersection J are adjusted based on the calculated traffic index.

The central apparatus 4 can execute, for the traffic signal controllers 1 that belong to its coverage area, a coordinated control of adjusting offsets of a plurality of intersections J included in a coordinated section, and a wide-area control (area traffic control) in which the coordinated control is expanded onto a road network, for example.

The central apparatus 4 may notify the traffic signal controllers in its coverage area of control type information including whether or not local actuated control at a specific intersection J is permitted.

When identification information that permits the local actuated control is included in the control type information received from the central apparatus 4, the traffic signal controller 1 executes a predetermined local actuated control such as PTPS (Public Transportation Priority System) for the intersection J in charge of the controller 1.

Based on the signal control parameters received from the central apparatus 4, the traffic signal controller 1 controls turn-on, turn-off, blinking, etc., of the signal light units 2. When executing the local actuated control, the traffic signal controller 1 can switch the light colors of the signal light units 2 according to the result of the control.

The traffic signal controller 1 is connected to the roadside communication apparatus 3 via a predetermined communication line. Therefore, the traffic signal controller 1 also functions as a relay device for communication between the central apparatus 4 and the roadside communication apparatus 3.

The roadside communication apparatus 3 is a middle-to-wide range wireless communication device based on a predetermined communication standard such as ITS (Intelligent Transport Systems) wireless system, wireless LAN, or LTE (Long Term Evolution). Therefore, the roadside communication apparatus 3 is wirelessly communicable with the on-vehicle devices 6 of the vehicles 5 traveling on the road.

The roadside communication apparatus 3 wirelessly transmits downlink information to the on-vehicle devices 6. The roadside communication apparatus 3 can include, in the downlink information, traffic jam information generated by the central apparatus 4, traffic signal information (signal light color switching information) generated by the traffic signal controller 1, etc.

Each on-vehicle device 6 receives the downlink information from the roadside communication apparatus 3 when the on-vehicle device 6 enters a communication area of the roadside communication apparatus 3 (e.g., an area within about 300 m upstream from the intersection J).

The on-vehicle device 6 transmits uplink information to the roadside communication apparatus 3 in a predetermined transmission cycle (e.g., 100 ms). The uplink information includes, for example, probe data indicating the travel locus of the vehicle 5. The probe data includes vehicle ID, data generation time, vehicle position, vehicle speed, vehicle heading, etc.

The roadside communication apparatus 3 can also include, in the downlink information, a message regarding whether or not passing of the platoon vehicles 5P through the intersection J is possible, as provision information directed to the platoon vehicles 5P. In the present embodiment, the central apparatus 4 generates the message regarding whether or not passing is possible.

The probe data transmitted from the on-vehicle device 6 of the platoon vehicles 5P includes vehicle ID, vehicle speed, and vehicle heading of the leading vehicle 5A, platoon head position (position of the front end of the leading vehicle 5A), platoon length, planned traveling route, preset deceleration (constant), etc.

The platoon length is, for example, the length from the platoon head position (position of the front end of the leading vehicle 5A) to a convoy tail position (position of the rear end of the tail-end vehicle 5D). The platoon length may be the length from the platoon head position to the position of the front end of the tail-end vehicle 5D.

The on-vehicle device 6 of the leading vehicle 5A specifies the number of vehicles (four in FIG. 1) included in the platoon vehicles 5P, based on the number of the following vehicles 5B to 5D that perform vehicle-to-vehicle communication with the vehicle 5A, and calculates the platoon length based on the specified number of vehicles, the length of each vehicle, and the inter-vehicle distance. The on-vehicle device 6 includes the value of the calculated platoon length in the probe data.

The planned traveling route is information indicating which route the platoon vehicles 5P will take after having passed through the intersection J. The planned traveling route is, for example, identification information of a road link connected to the intersection J.

The on-vehicle device 6 of the leading vehicle 5A performs map matching of a planned traveling path calculated by a navigation device (not shown) of the leading vehicle 5A, with road map data, to identify the road link after passing through the intersection J, and includes identification information of the road link in the probe data.

The preset deceleration is a representative value (e.g., average value) of deceleration from when a brake starts to work to when the vehicle 5 safely stops. Generally, the heavier the vehicle 5 is, the harder it is for the vehicle 5 to smoothly come to a stop.

Therefore, when the vehicles included in the platoon vehicles 5P are cargo vehicles such as trucks, different values of preset decelerations may be adopted according to the loads thereof. In this case, for example, the value of preset deceleration may be gradually decreased for a vehicle that is heavily loaded.

[Structure of Traffic Signal Controller]

Figure 2:
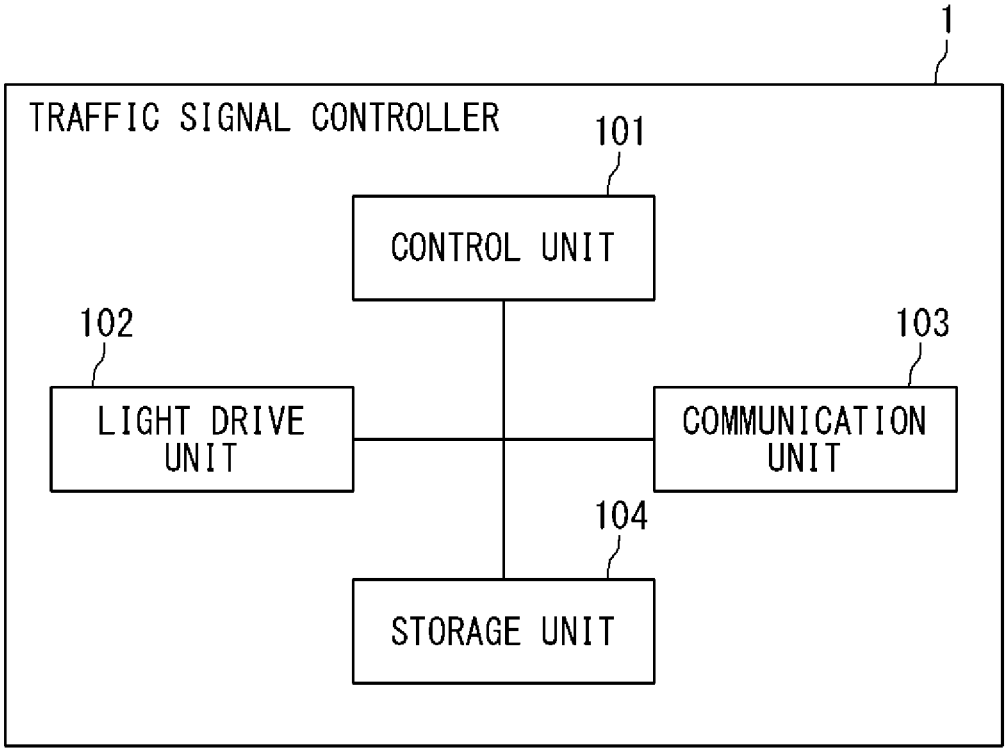
FIG. 2 is a block diagram showing an example of an internal structure of a traffic signal controller.

FIG. 2 is a block diagram showing an example of an internal structure of the traffic signal controller 1.

As shown in FIG. 2, the traffic signal controller 1 includes a control unit 101, a light drive unit 102, a communication unit 103, and a storage unit 104.

The control unit 101 is implemented by one or a plurality of microcomputers, and is connected to the light drive unit 102, the communication unit 103, and the storage unit 104 via an internal bus. The control unit 101 controls the operations of these hardware units.

The control unit 101 usually determines a light color switching timing of each signal light unit 2 in accordance with the signal control parameters that are determined by the central apparatus 4 based on the traffic actuated control.

When the local actuated control is permitted by the control type information from the central apparatus 4, the control unit 101 may determine a light color switching timing of each signal light unit 2 in accordance with the result of the local actuated control performed in the traffic signal controller 1.

The light drive unit 102 includes a semiconductor relay (not shown), and turns on/off an AC voltage (AC 100 V) or a DC voltage that is supplied to each of signal lights of the signal light unit 2, based on the signal switching timing determined by the control unit 101.

The communication unit 103 is a communication interface that performs wired communication with the central apparatus 4 and the roadside communication apparatus 3. Upon receiving the signal control parameters from the central apparatus 4, the communication unit 103 transmits the parameters to the control unit 101. Upon receiving the provision information directed to vehicles from the central apparatus 4, the communication unit 103 transmits the provision information to the roadside communication apparatus 3.

The communication unit 103 receives the probe data of the vehicles 5 including the platoon vehicles 5P from the roadside communication apparatus 3 almost in real time (e.g., at intervals of 0.1 to 1.0 sec).

The storage unit 104 is implemented by a storage medium such as a hard disk or a semiconductor memory. The storage unit 104 temporarily stores therein various kinds of information (signal control parameters, probe data, etc.) received by the communication unit 103.

The storage unit 104 also stores therein a computer program that allows the control unit 101 to realize local actuated control, etc.

[Structure of Central Apparatus]

Figure 3:
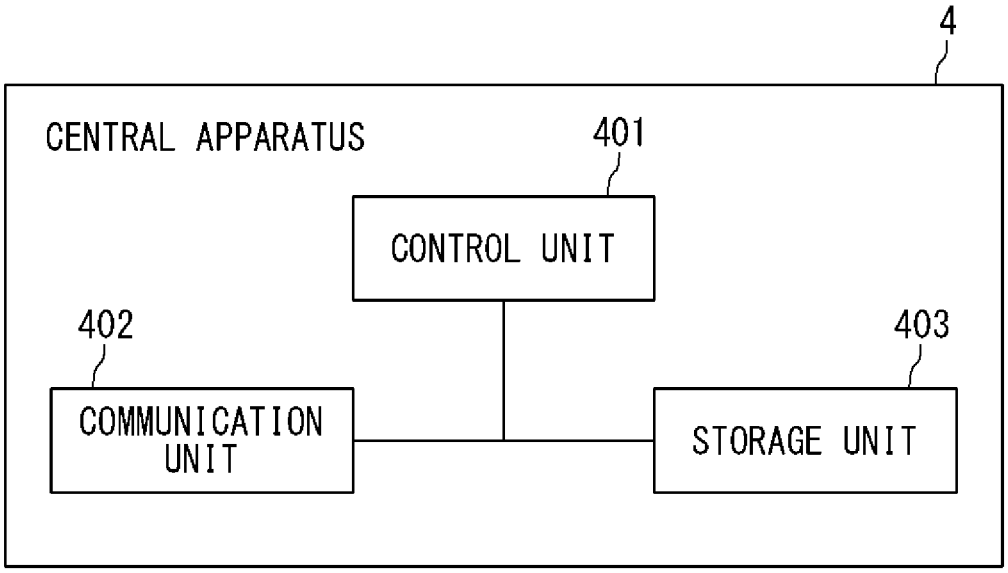
FIG. 3 is a block diagram showing an example of an internal structure of a central apparatus.

FIG. 3 is a block diagram showing an example of the internal structure of the central apparatus 4.

As shown in FIG. 3, the central apparatus 4 includes a control unit 401, a communication unit (acquisition unit) 402, and a storage unit 403.

The control unit 401 is implemented by a work station (WS), a personal computer (PC), or the like. The control unit 401 collects various kinds of information from the traffic signal controller 1 and the roadside communication apparatus 3, processes (operates) and stores the information, and comprehensively performs signal control, information provision, etc.

The control unit 401 is connected to the aforementioned hardware units via an internal bus, and controls the operations of these units.

The communication unit 402 is a communication interface that is connected to the LAN side via a communication line. The communication unit 402 transmits the signal control parameters of the signal light units 2 at the intersection J to the traffic signal controller 1 in each predetermined cycle (e.g., 1.0 to 2.5 min).

The communication unit 402 receives, from the traffic signal controller 1, the probe data which is acquired by the roadside communication apparatus 3 and is necessary for traffic actuated control (central actuated control) to be performed by the central apparatus 4. The communication unit 402 transmits the signal control parameters, the control type information, etc., to the traffic signal controller 1.

In the example of FIG. 1, the communication unit 402 of the central apparatus 4 receives, via the traffic signal controller 1, the probe data that is uplink-transmitted from the roadside communication apparatus 3. However, the communication unit 402 may receive the probe data through direct communication with the roadside communication apparatus 3.

The communication unit 402 functions as an acquisition unit for acquiring information (platoon length, planned traveling route, etc.) necessary for generating provision information to the platoon vehicles 5P.

Figure 4:
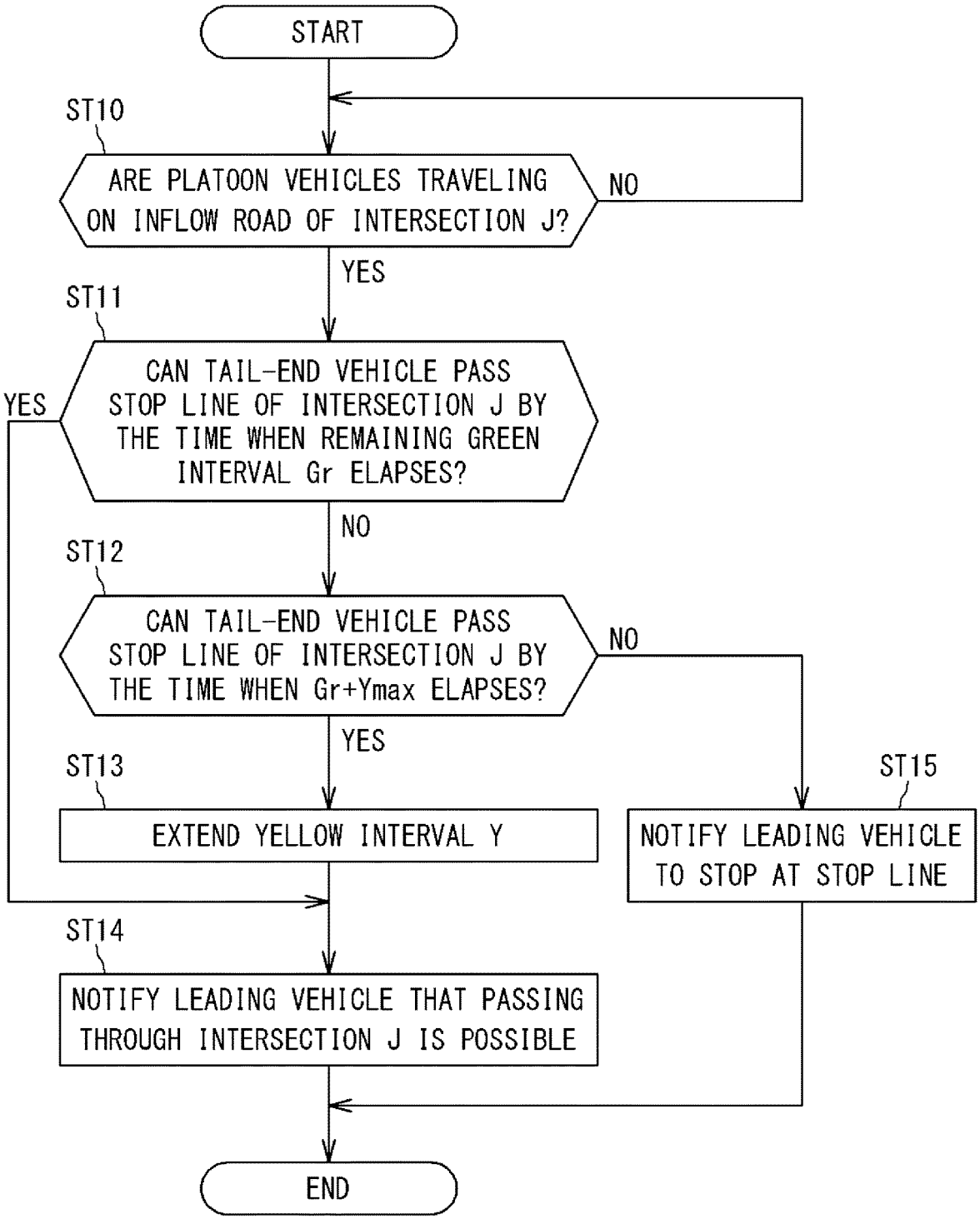
FIG. 4 is a flowchart showing an example of first preferential control for platoon.
Figure 6:
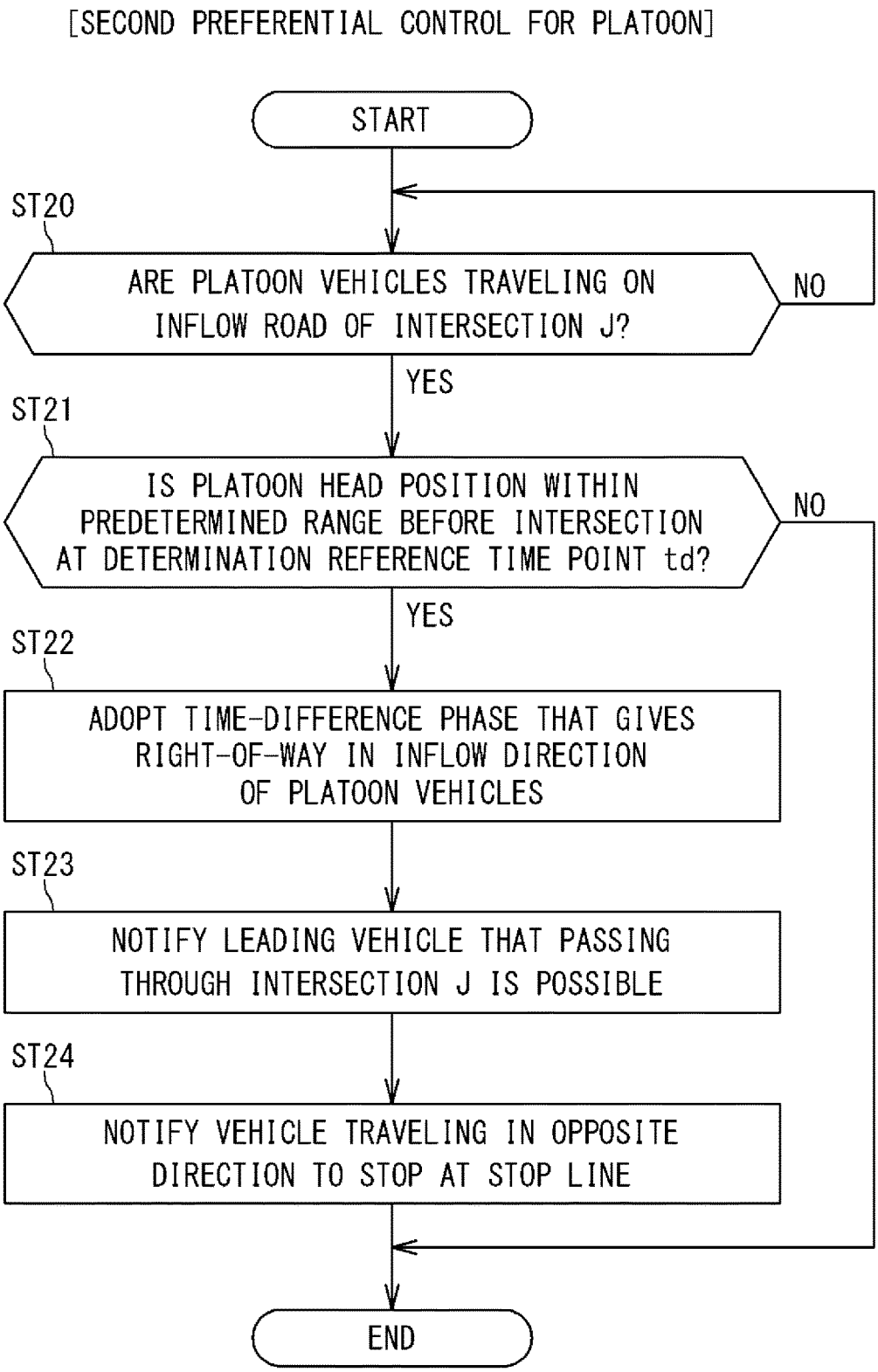
FIG. 6 is a flowchart showing an example of second preferential control for platoon.

The storage unit 403 is implemented by a hard disk, a semiconductor memory, or the like, and stores therein a computer program that executes preferential control for platoon described below (FIG. 4 and FIG. 6).

The storage unit 403 stores therein information necessary for executing the preferential control for platoon, such as step information including signal light colors for steps and the number of seconds for each step, and the position of the intersection J.

The storage unit 403 temporarily stores therein the signal control parameters generated by the control unit 401, the probe data received from the roadside communication apparatus 3, etc.

The control unit 401 reads the aforementioned computer program from the storage unit 403 and performs information processing, thereby executing "preferential control for platoon" that allows the platoon vehicles 5P to smoothly pass through the intersection J. Hereinafter, the content of this control will be described.

[First Preferential Control for Platoon]

FIG. 4 is a flowchart showing an example of first preferential control for platoon. In FIG. 4, "intersection J" is a target intersection at which the first preferential control for platoon is executed, "Gr" is a remaining green interval of the intersection J at the present time, and "Y" is a yellow interval of the intersection J.

In FIG. 4, it is assumed that the intersection J is an intersection the clearance interval of which can be extended. Although the clearance interval is the total time of the yellow interval Y and all red interval AR, the yellow interval Y is to be extended in the present embodiment. "Ymax" is the maximum value of the yellow interval Y that can be extended at the intersection J.

As shown in FIG. 4, on the condition that the platoon vehicles 5P are traveling on the inflow road of the intersection J (step ST10), the control unit 401 of the central apparatus 4 executes step S11 and the subsequent steps.

Whether or not the platoon vehicles 5P are traveling on the inflow road of the intersection J can be determined based on, for example, the vehicle position, the vehicle speed, and the vehicle heading of the leading vehicle 5A.

When the platoon vehicles 5P are traveling on the inflow road of the intersection J1, the control unit 401 determines whether or not the tail-end vehicle 5D of the platoon vehicles 5P can pass a stop line of the intersection J by the time the remaining green interval Gr of the intersection J1 elapses (step ST11).

A reference position of the tail-end vehicle 5D to be contrasted to the stop line may be either the front end or the rear end of the tail-end vehicle 5D. In this embodiment, the reference position is the front end. In this case, the process in step ST11 is as follows.

That is, assuming that the distance from the stop line of the intersection J to the platoon head position at the present time is X, the distance from the platoon head position to the front end of the tail-end vehicle 5D is Xp, and the vehicle speed of the platoon vehicles 5P is Vp, the control unit 401 determines that the tail-end vehicle 5D can pass the stop line of the intersection J, when the following inequality (1) is satisfied:

$$Gr \times Vp \geq X + Xp \tag{1}$$

When the determination result in step ST11 is positive (when inequality (1) is satisfied), the control unit 401 generates "first message" that notifies the leading vehicle 5A that the platoon vehicles 5P can pass through the intersection J, and transmits the message to the roadside communication apparatus 3 (step ST14). Therefore, the first message is downlink-transmitted by the roadside communication apparatus 3.

Upon receiving the first message, the on-vehicle device 6 of the leading vehicle 5A notifies the driver of the content of the first message through a display device, a voice output device, or the like in the vehicle 5A.

Thus, the driver of the leading vehicle 5A can perceive that the tail-end vehicle 5D of the platoon vehicles 5P can pass through the intersection J, in advance before the intersection J.

When the determination result in step ST11 is negative (when inequality (1) is not satisfied), the control unit 401 determines whether or not the tail-end vehicle 5D of the platoon vehicles 5P can pass through the intersection J by the time the remaining green interval Gr and the maximum value Ymax of the yellow interval elapse (step ST12).

Specifically, when the following inequality (2) is satisfied, the control unit 401 determines that the platoon vehicles 5P can pass through the intersection J.

$$(Gr + Y\max) \times Vp \geq X + Xp \tag{2}$$

When the determination result in step ST12 is negative (when inequality (2) is not satisfied), the control unit 401 generates "second message" that notifies the leading vehicle 5A to stop at the stop line, and transmits the second message to the roadside communication apparatus 3 (step ST15). Therefore, the second message is downlink-transmitted to the roadside communication apparatus 3. The control unit 401 ends the processing after execution of step ST15.

Upon receiving the second message, the on-vehicle device 6 of the leading vehicle 5A notifies the driver of the content of the second message through the display device or the voice output device in the vehicle 5A.

Thus, the driver of the leading vehicle 5A can perceive that the tail-end vehicle 5D of the platoon vehicles 5P cannot pass through the intersection J, in advance before the intersection J.

When the determination result in step ST12 is positive (when inequality (2) is satisfied), the control unit 401 extends the yellow interval Y by a predetermined time ΔY so that the tail-end vehicle 5D can pass the stop line of the intersection J by the time the yellow light finishes (step ST13), and thereafter executes the process of "notifying that passing is possible" in step ST14.

Specifically, the control unit 401 extends the yellow interval Y by the predetermined time ΔY calculated according to the following equation (3).

$$(Gr + Yi + \Delta Y) \times Vp = X + Xp$$

$$\therefore \Delta Y = (X + Xp)/Vp - (Gr + Yi) \tag{3}$$

[Effects of First Preferential Control for Platoon]

Figure 5:
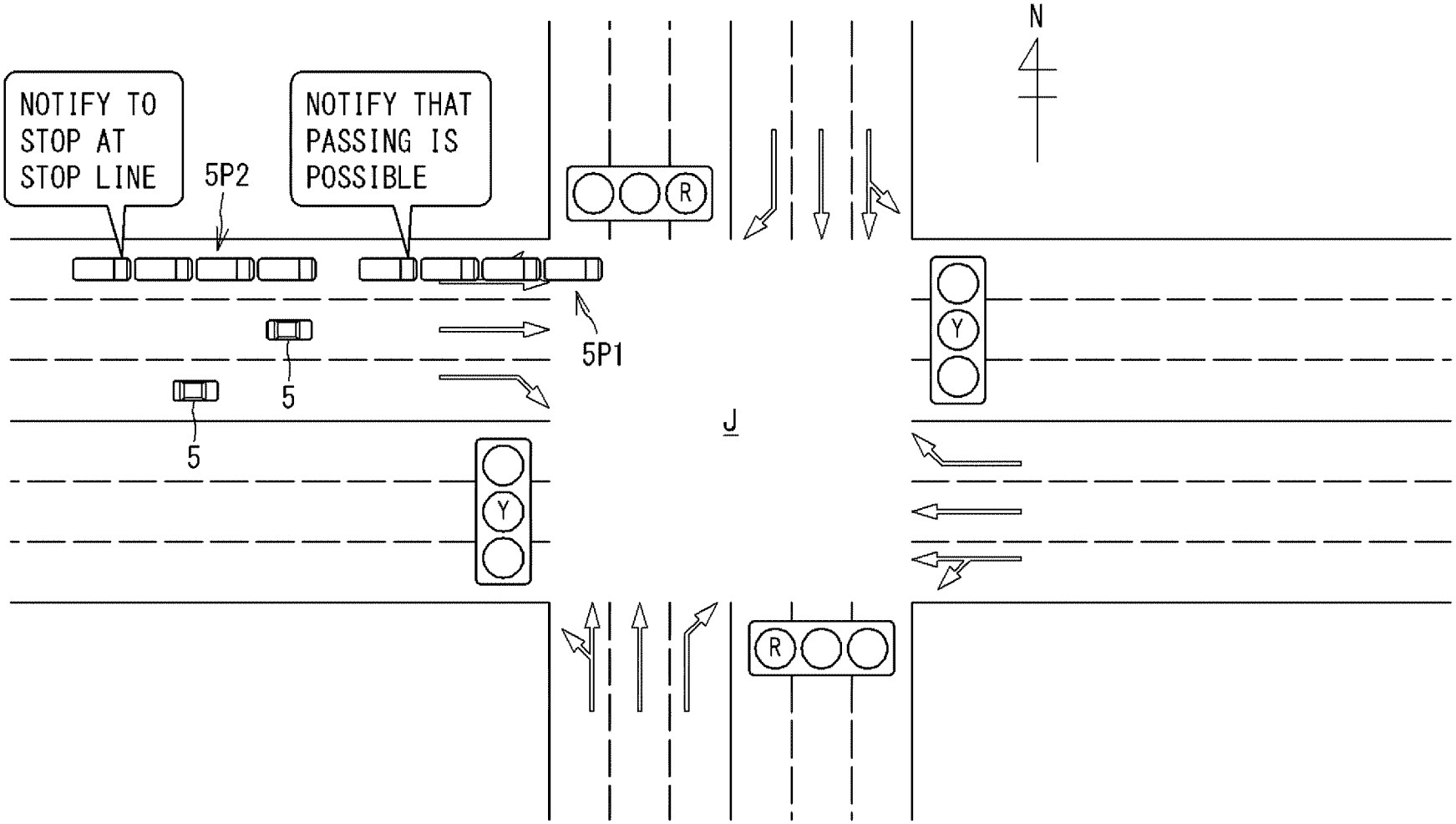
FIG. 5 is a road plan view showing effects of the first preferential control for platoon.

FIG. 5 is a road plan view showing the effects of the first preferential control for platoon.

As shown in FIG. 5, it is assumed that platoon vehicles 5P1 traveling eastward are notified that they can pass through the intersection J, while the following platoon vehicles 5P2 traveling westward are notified to stop at the stop line.

In this case, according to the first preferential control for platoon, the yellow interval Y of the intersection J is extended until the tail-end vehicle 5D of the preceding platoon vehicles 5P1 passes the stop line of the intersection J.

On the other hand, the following platoon vehicles 5P1 are notified to stop at the stop line, and therefore almost certainly stop just before the intersection J. Meanwhile, ordinary vehicles 5 present behind the preceding platoon vehicles 5P1 are highly likely to stop before the intersection J due to the yellow light Y.

As described above, the first preferential control for platoon allows the tail-end vehicle 5D to pass the stop line of the intersection J by extending not the green interval but the clearance interval (in the present embodiment, the yellow light Y).

Therefore, even when the platoon vehicles 5P2 and the ordinary vehicles 5 are present behind the platoon vehicles 5P1, these vehicles are prevented from following the platoon vehicles 5P1 and passing through the intersection J. Therefore, the platoon vehicles 5P1 can pass through the intersection J more smoothly, compared to the preferential control with the green interval being extended.

[Second Preferential Control for Platoon]

FIG. 6 is a flowchart showing an example of second preferential control for platoon.

In FIG. 6, "intersection J" is a target intersection at which the second preferential control for platoon is executed. In the second preferential control for platoon, it is assumed that the intersection J is an intersection capable of executing "movement control" in which whether or not time-difference phase is applicable is dynamically determined according to the traffic condition of at least one inflow road (refer to Japanese Laid-Open Patent Publication No. 2012-103843, for example).

The "time-difference phase" is a signal phase as follows. For example, between a pair of inflow roads opposing each other, in order to promote traffic flow on one inflow road where traffic jam is likely to occur due to many right-turn vehicles being uncontrolled, the green interval for this inflow road is extended while the green interval for the other inflow road is aborted.

Figure 7:
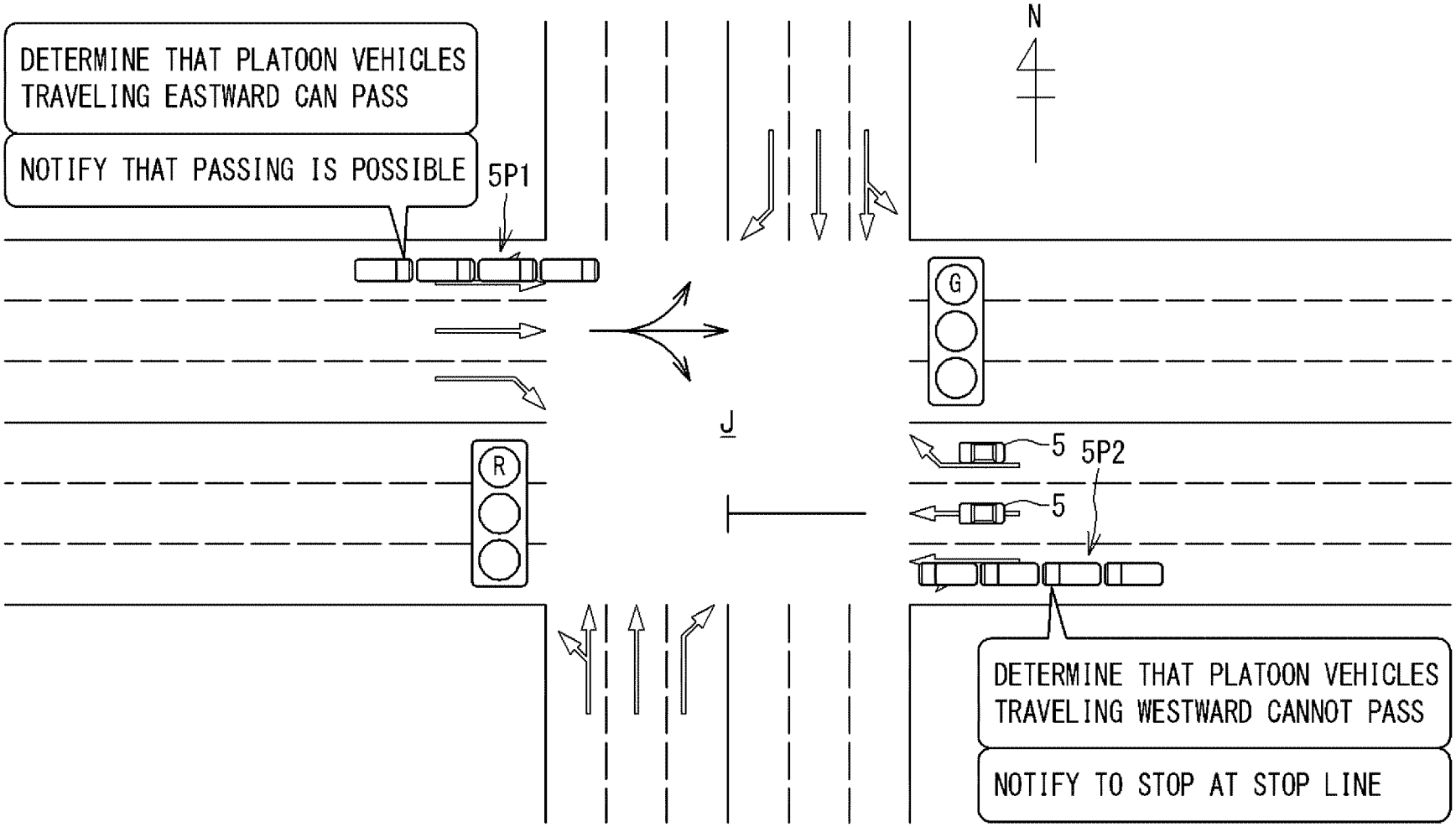
FIG. 7 is a road plan view showing effects of the second preferential control for platoon.

As shown in FIG. 7, on the condition that the platoon vehicles 5P are traveling on an inflow road of the intersection J (step ST20), the control unit 401 of the central apparatus 4 executes step S21 and the subsequent steps.

Whether or not the platoon vehicles 5P are traveling on the inflow road of the intersection J can be determined based on, for example, the vehicle position, the vehicle speed, and the vehicle heading of the leading vehicle 5A.

In the case where the platoon vehicles 5P are traveling on the inflow road of the intersection J, the control unit 401 determines whether or not the platoon head position of the platoon vehicles 5P is present within a predetermined range before the intersection J (e.g., a range of 100 m upstream from the stop line), at "determination reference time point td" of the inflow road where the platoon vehicles 5P are traveling (step ST21).

The determination reference time point td is a reference time point at which determination is made as to which direction has a time-difference phase to be adopted. For example, the determination reference time point td is set to a time point when a step of PF (yellow for pedestrian) is finished.

When the determination result in step ST21 is negative, the control unit 401 ends the processing without executing steps ST22 to ST24. Therefore, a time-difference phase regarding the inflow direction of the platoon vehicles 5P is not adopted.

When the determination result in step ST21 is positive, the control unit 401 adopts a time-difference phase that gives right-of-way in the inflow direction of the platoon vehicles 5P (step ST22).

Thus, the platoon vehicles 5P are allowed to go straight ahead through the intersection J and turn right as well as turn left, and thus right-of-way in the opposite direction with respect to the platoon vehicles 5P is aborted.

When the determination result in step ST21 is positive, the control unit 401 notifies the leading vehicle 5A of the platoon vehicles 5P that the platoon vehicles 5P can pass through the intersection J (step ST23), and notifies the vehicles traveling in the opposite direction to stop at the stop line (step ST24).

[Effects of Second Preferential Control for Platoon]

FIG. 7 is a road plan view showing the effects of the second preferential control for platoon.

As shown in FIG. 7, between the platoon vehicles 5P1 traveling eastward and the platoon vehicles 5P2 traveling westward, the former arrives at the intersection J earlier, and therefore, it is assumed that a time-difference phase that gives right-of-way to the platoon vehicles 5P1 traveling eastward is adopted.

In this case, according to the second preferential control for platoon, the platoon vehicles 5P1 traveling eastward are allowed by the time-difference phase to pass through the intersection J in all the directions, i.e., straight ahead, left-turn, and right-turn. The vehicles 5 traveling westward, including the platoon vehicles 5P2, stop at the stop line of the intersection J and do not impede passing of the platoon vehicles 5P1 through the intersection J.

Therefore, the platoon vehicles 5P1 can pass through the intersection J more smoothly, compared to the preferential control with the green interval being extended.

[Modifications]

The embodiment (including modifications) disclosed herein is merely illustrative and not restrictive in all aspects. The scope of the present disclosure is not limited to the embodiment described above, and includes all changes which come within the scope of equivalency of configurations described in the claims.

In the aforementioned embodiment, the control unit 401 of the central apparatus 4 executes the first and second preferential control for platoon (FIG. 4 and FIG. 6). However, any of other roadside devices such as the traffic signal controller 1 and the roadside communication apparatus 3 may execute the first and second preferential control for platoon.

That is, a control device for executing the first and second preferential control for platoon may be any of the central apparatus 4, the traffic signal controller 1, and the roadside communication apparatus 3.

In the aforementioned embodiment, the traffic signal controller 1, the central apparatus 4, and the on-vehicle device 6 each may have a communication function based on the fifth-generation mobile communication system (5G).

In this case, if the central apparatus 4 is an edge server that has less delay than a core server, delay in communication between the central apparatus 4 and the on-vehicle device 6 can be reduced. This allows the central apparatus 4 to execute, based on probe data, traffic signal control with improved real-time property.

REFERENCE SIGNS LIST

1 traffic signal controller (traffic signal control apparatus)
2 signal light unit
3 roadside communication apparatus (traffic signal control apparatus)
4 central apparatus (traffic signal control apparatus)
5 vehicle
5A leading vehicle
5B to 5D following vehicles
5P platoon vehicles
5P1 preceding platoon vehicles
5P2 following platoon vehicles
6 on-vehicle device
101 control unit
102 light drive unit
103 communication unit
104 storage unit
401 control unit
402 communication unit (acquisition unit)
403 storage unit

The invention claimed is:

1. A traffic signal control apparatus capable of controlling signal light colors at a target intersection, comprising:

an acquisition unit configured to acquire positional information of a tail-end vehicle among platoon vehicles traveling on an inflow road of the target intersection, and a vehicle speed of the platoon vehicles; and a control unit configured to, when the tail-end vehicle cannot pass a stop line of the target intersection by the time a remaining green interval elapses, execute preferential control that allows the platoon vehicles to preferentially pass through the target intersection by extending a clearance interval of the target intersection.

2. The traffic signal control apparatus according to claim 1, wherein when the control unit extends the clearance interval of the target intersection, the control unit notifies the platoon vehicles that the vehicles can pass through the target intersection.

3. The traffic signal control apparatus according to claim 1, wherein when the control unit does not extend the clearance interval of the target intersection, the control unit notifies the platoon vehicles to stop at the stop line of the target intersection.

4. A traffic signal control method for controlling signal light colors at a target intersection, the method comprising:

acquiring positional information of a tail-end vehicle among platoon vehicles traveling on an inflow road of the target intersection, and a vehicle speed of the platoon vehicles; and when the tail-end vehicle cannot pass a stop line of the target intersection by the time a remaining green interval elapses, executing preferential control that allows the platoon vehicles to preferentially pass through the target intersection by extending a clearance interval of the target intersection.

5. A non-transitory computer readable storage medium storing a computer program configured to cause a computer to function as a traffic signal control apparatus capable of controlling signal light colors at a target intersection, the computer program causing the computer to function as:

an acquisition unit configured to acquire positional information of a tail-end vehicle among platoon vehicles traveling on an inflow road of the target intersection, and a vehicle speed of the platoon vehicles; and a control unit configured to, when the tail-end vehicle cannot pass a stop line of the target intersection by the time a remaining green interval elapses, execute preferential control that allows the platoon vehicles to preferentially pass through the target intersection by extending a clearance interval of the target intersection.

* * * * *